United States Patent [19]

Payne

[11] 4,093,524

[45] June 6, 1978

[54] BONDING OF REFRACTORY HARD METAL

[75] Inventor: John R. Payne, Pleasanton, Calif.

[73] Assignee: Kaiser Aluminum & Chemical Corporation, Oakland, Calif.

[21] Appl. No.: 846,061

[22] Filed: Oct. 27, 1977

Related U.S. Application Data

[63] Continuation-in-part of Ser. No. 749,563, Dec. 10, 1976, abandoned.

[51] Int. Cl.[2] ..... C25B 1/00; C25C 3/06; C25C 3/08; C25C 7/02

[52] U.S. Cl. ..... 204/61; 204/67; 204/243 R; 204/290 R; 219/118; 428/469

[58] Field of Search ..... 204/1, 243 R, 244–247, 204/290; 428/469; 228/121, 122, 124; 219/117 R, 118

[56] References Cited

U.S. PATENT DOCUMENTS

| | | | |
|---|---|---|---|
| 3,400,061 | 9/1968 | Lewis et al. | 204/243 R X |
| 3,607,685 | 9/1971 | Johnson | 204/243 R X |
| 3,661,736 | 5/1972 | Holliday | 204/243 R |
| 3,666,654 | 5/1972 | Garab | 204/243 R |

*Primary Examiner*—John H. Mack
*Assistant Examiner*—D. R. Valentine
*Attorney, Agent, or Firm*—Paul E. Calrow; Edward J. Lynch

[57] ABSTRACT

The invention is directed to a method of bonding refractory hard metal materials such as $TiB_2$ wherein aluminum carbide is formed in situ at the interface between the refractory hard metal and a substrate. The bond formation is greatly accelerated by passing an electrical current across the interface.

19 Claims, 3 Drawing Figures

BONDING OF REFRACTORY HARD METAL

RELATED APPLICATIONS

This application is a continuation-in-part of application Ser. No. 749,563 filed Dec. 10, 1976, now abandoned.

BACKGROUND OF THE INVENTION

This invention generally relates to the use of $TiB_2$ and other refractory hard metal alloys (hereinafter referred to collectively as RHM), as an electrode surface in an aluminum reduction cell.

Ransley et al (U.S. Pat. No. 2,756,743) were probably the first to appreciate the utilization of RHM as cathode materials in an aluminum reduction cell. RHM in pure form are very resistant to the molten aluminum and cryolite found in an aluminum reduction cell and moreover generally have higher conductivities than the conventional carbon products used in a reduction cell. In addition, RHM and in particular $TiB_2$ are readily wet by molten aluminum, whereas the carbon products normally used are not.

Although the use of RHM in aluminum reduction cells was conceptually a significant improvement, such use was fraught with practical problems and as a result the development of RHM cathodes has never met with any significant commercial success.

One major problem faced by the workers in this area was the deleterious effects of oxide in the RHM shapes used in the reduction cell. Normally the RHM shapes were formed from RHM powder by either hot pressing or cold pressing and sintering. However, the surfaces of the RHM particles were oxidized to a certain extent so that, when the powder was pressed into various shapes, a high concentration of oxide resulted at the inter-particle or grain boundaries. The inter-granular oxide could be readily attacked by molten aluminum so that the RHM particles or grains could be easily dislodged after molten aluminum attack at the grain boundaries, resulting in the rapid deterioration of the protective RHM cathode surface. During the development work by Ransley, Lewis and others on RHM cathode materials, it was well known that the oxide content of RHM shapes must be kept as low as possible to avoid intergranular attack by molten aluminum. However, the art of RHM manufacture was not sufficiently advanced at that time to produce high purity RHM products which could withstand attack by molten aluminum for any significant period. Theoretically, RHM with no oxide content at all would be best but such material is impossible to obtain in a commercial process. Lately, several manufacturers have been able to produce relatively large $TiB_2$ shapes with oxide contents much less than 0.05%, which makes the $TiB_2$ shapes very resistant to molten aluminum attack even at the grain boundaries where the oxide tends to be concentrated.

Although the RHM products are very strong, they are also quite brittle and subject to thermal shock. As a general rule RHM shapes should not be subjected to a temperature differential greater than 200° to avoid thermal cracking.

A particularly attractive aluminum reduction cell design utilizing RHM cathodic surfaces is shown in U.S. Pat. No. 3,400,061 assigned to the present assignee wherein the RHM cathode surfaces are sloped so that only a thin layer of molten aluminum which wets the RHM surface remains. The molten aluminum electrolytically formed during the operation of the cell drains from the sloped surface into the trough or trench located at the middle of the cell. The molten aluminum in the trough is not a part of the electrolytic circuit and can be removed as desired. Only the thin layer of molten aluminum which wets the RHM cathodic surface is involved in current transfer.

Notwithstanding the suitability of the cell design described in U.S. Pat. No. 3,400,061 a significant problem remained, however, due to the extremely large difference in thermal expansion between RHM shapes and the supporting conductive carbonaceous substrate. The large difference in thermal expansion coefficients (e.g. about $2 \times 10^{-6}$ v. $8 \times 10^{-6}$ in/in °F) precluded forming a bond which would be effective both during installation of the RHM shapes at room temperature and the operating temperature of the aluminum reduction cell (e.g., about 975° C). Any bond formed at room temperature when the plate or tiles of RHM were installed would be essentially destroyed by the thermal expansion during heat-up to operating temperature.

The patents and technical literature are replete with references which describe attempts to solve the various problems in the use of $TiB_2$ and other RHM in the harsh environments of an aluminum reduction cell. Lewis et al. in U.S. Pat. No. 3,400,061 and others, utilized a mixture of $TiB_2$ and other refractory hard metals with small amounts of carbon to reduce the relatively large thermal expansion of the RHM materials. However, such composites did not have the service life necessary for commercial usage due to their susceptibility of attack by the electrolytic bath. References such as U.S. Pat. Nos. 2,915,442, 3,081,254, 3,151,053, 3,161,579 and 3,257,307, describe RHM cathode bars in various positions. However, the RHM cathode bars usually could not withstand the thermal distortion attendant with such design and they inevitably fractured due to the brittleness of the RHM.

Holliday in U.S. Pat. No. 3,661,736 suggested the use of a composite material comprising fused RHM particles in a binder of carbonaceous material or aluminum carbide as a cathodic surface. It was alleged that a film of aluminum carbide formed on the carbonaceous surface not protected by RHM particles which reduced the attack by the electrolytic bath. However, when aluminum carbide is exposed to molten cryolite, the aluminum carbide is readily dissolved, and in an aluminum reduction cell it is nearly impossible to prevent contact of the cathode surface by cryolite. In the operation of the cell, cryolite would attack the aluminum carbide film as well as the aluminum carbide matrix which holds the particles leading to the early destruction of the cathodic surface.

It is against this background that the present invention was developed.

DESCRIPTION OF THE INVENTION

This invention is directed to an improved method of bonding $TiB_2$ and other RHM materials to a conductive substrate, particularly a conductive carbonaceous substrate, which will have a suitable service life in the harsh environment of an aluminum reduction cell. Although the following description of the invention is specifically directed to $TiB_2$ such reference shall also include RHM materials such as titanium carbide, zirconium boride, zirconium carbide and various combinations thereof, with or without additional components. The $TiB_2$ material should have an oxygen content of less than 0.05%, preferably less than 0.01% (by weight).

In accordance with the general concept of the invention, molten aluminum and a carbonaceous material, preferably finely divided, are caused to react at the interface between the $TiB_2$ material and a conductive supportive substrate to thereby form an aluminum carbide bond between the $TiB_2$ and the substrate. The aluminum carbide bond generally forms at or near the operating temperature of an aluminum reduction cell so there will be essentially no destructive differential expansion between the $TiB_2$ and the conductive substrate during cell operation. The bond formation is greatly accelerated by passing an electrical current across the $TiB_2$ substrate interface.

In a preferred embodiment a graphitic cement containing finely divided graphite particles and an organic vehicle of low molecular weight is employed as an adhesive for installing the $TiB_2$ in such shapes as tiles or other forms having a large planar surface onto a conductive carbon substrate. If desired, powdered aluminum, aluminum flakes, aluminum wire screen, aluminum foil, and the like, can be incorporated into the graphitic cement or otherwise placed at the interface to ensure molten aluminum across a large portion of the interface at the temperature of aluminum carbide formation to facilitate an adequate bond throughout the interfacial area. A temporary bond is formed by the graphitic cement during installation of the tiles but it is severely weakened or destroyed during heat-up due to the large differential thermal expansion. As a result there is a period of time before the complete formation of the aluminum carbide bond that the $TiB_2$ shapes are rather loosely held, and care must be exercised during this period so that the $TiB_2$ shapes do not become displaced.

The aluminum carbide bond formation is greatly accelerated by passing an electrical current across the interface but the mechanisms thereof are not presently understood. It appears that under the influence of the electrical current, molten aluminum is driven into the interface between the $TiB_2$ shape and the substrate so that, if aluminum is not incorporated into the interface during installation, the aluminum carbide bond will still form. It is well recognized that aluminum carbide rapidly forms when molten aluminum contacts carbon (absent a protective oxide layer on the molten aluminum); however when the inventor attempted to develop an aluminum carbide bond by maintaining molten aluminum on the top surface of $TiB_2$ plate without the influence of an electrical current essentially no molten aluminum penetrated to the interface, so essentially no aluminum carbide bond was formed.

For highly effective bond formation the current density should range from about 2 to 20 amps/in$^2$ (31–310 amps/cm$^2$) preferably about 4 to 10 amps/in$^2$ (62–155 amps/cm$^2$).

The aluminum carbide bond generally forms at a temperature between about 1400° and 2000° F (760°–1093° C). If aluminum metal is included with the finely divided carbonaceous material when installing the $TiB_2$ shapes, the bonding reaction proceeds quite rapidly. However, if no aluminum is included during installation, then bond formation must depend upon molten aluminum being driven into the interfacial area by capillary action under the influence of an electrical current which can be a relatively slow process. In this latter method at least 12 hours, preferably more than 24 hours, are usually needed for minimal bond formation. During this period care must be exercised so as to avoid displacing the shapes because during this period there is essentially little or no bond between the shapes and the substrate.

The aluminum carbide bond is very thin on the order of about 1 mm. An excessively thick bond layer is not desired, particularly if the spacing between plate is large, because this would allow attack and penetration of cryolite into the interfacial area thereby destroying the aluminum carbide bond.

In accordance with the invention the $TiB_2$ shapes such as tiles or plates are closely positioned adjacent to one another so there is little exposure of the aluminum carbide bond to the electrolytic bath except at the mating edges of the shapes. Moreover, if any cryolite does contact the aluminum carbide along the egdes of the bond, it is unable to penetrate underneath the $TiB_2$ shape where most of the bonding occurs. Usually, a film of molten aluminum bridges the gap between the plates and minimizes cryolite attack.

When installing the $TiB_2$ plates (or tiles), the gap between the adjacent edges of the plates should be less than about 0.5 inch (12.7 cm) preferably less than 0.25 in (6.4 cm) but generally greater than the thermal expansion expected from the $TiB_2$ plate at operational temperatures of the cell. Additionally, clearance between the $TiB_2$ plates should not be in excess of the distance capable of being bridged by molten aluminum. As a rule of thumb the gap should be no greater than the thickness of the $TiB_2$ tile to avoid bond attack. If the plates are installed too closely they will override one another at operating temperatures due to the thermal expansion thereof and necessarily result in the rapid deterioration of the cell lining. Moreover, if the cell design is that described by Lewis et al in U.S. Pat. No. 3,400,061 which involves a very small anode-cathode distance, displaced $TiB_2$ plate can interfere with cell operation.

The $TiB_2$ planar surfaces of the $TiB_2$ shapes should be relatively flat so that there are not large areas of the planar surfaces which do not contact the substrate. The thickness of the $TiB_2$ plate, which should be relatively small in comparison with the width and length thereof, generally should range from about $\frac{5}{8}$ in. (0.32 cm) to about 1 in. (2.54 cm).

The conductive substrate can be formed of suitable nonmetallic materials such as graphite, silicon carbide and the like. Metallic substrates are not desired because any defect which allows molten aluminum to contact the metal substrate will result in the rapid dissolution thereof.

Reference is made to the drawings which illustrate a preferred aluminum reduction cell design employing a sloped cathodic surface having $TiB_2$ plate bonded to a carbonaceous substrate in accordance with the invention.

Figure 1:
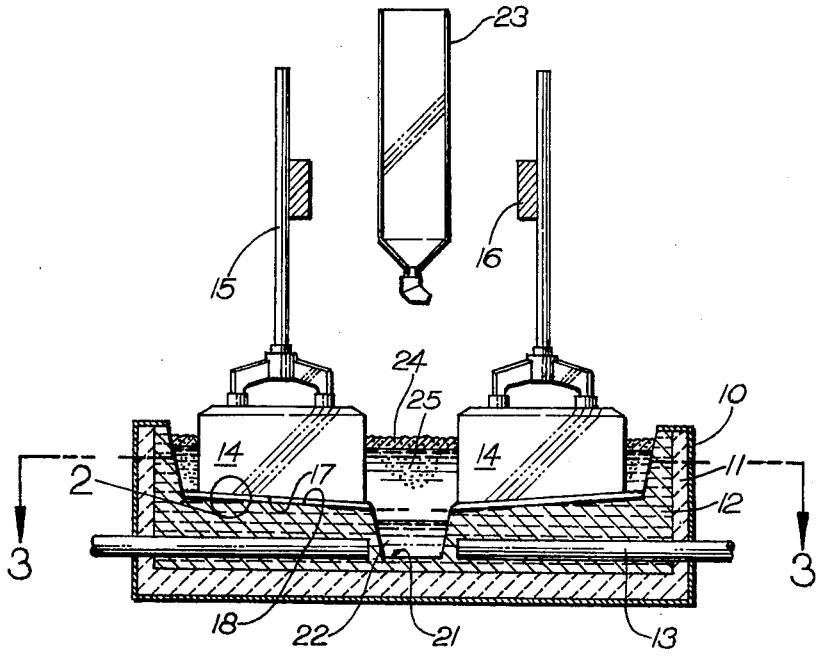
FIG. 1 is a vertical section of the aluminum reduction cell.
Figure 2:
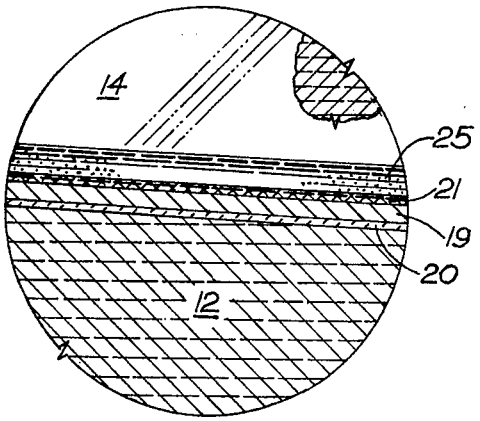
FIG. 2 is a detailed section of a portion of FIG. 1, circled at 2.

With particular reference to FIG. 1, the reduction cell comprises a steel shell 10 having an insulating layer 11 of suitable refractory material and a carbonaceous layer 12 which may be either a monolithic layer which is baked in place or prebaked carbon blocks, as in conventional reduction cells. Cathode bars 13 are positioned within the carbon layer 12. Anodes 14 are supported within the cell cavity through anode rods 15 which are electrically and mechanically connected to the anode bus bars 16 by suitable means not shown. The bottom surface 17 of the anodes 14 are sloped to correspond to the slope of the cathode surface 18 which is shown in more detail in FIG. 2. The sloped cathode surface 18 generally has a plurality of $TiB_2$ plates 19 which are bonded to the carbonaceous substrate 12 by means of an aluminum carbide bond 20. A thin film 21 of molten aluminum which wets the tiled surface is maintained on the $TiB_2$ surface and the thickness thereof is controlled by the slope of the cathode surface, which may be about 1°-10° from the horizontal.

During the operation of the cell molten aluminum drains from surface 18 as it is formed into the trench 21 which is also preferably lined with $TiB_2$ plate. The body of molten aluminum 22 contained in the trench 21 carries no electrical current and can be withdrawn as desired. Alumina is fed to the cell from container 23 which is supported by suitable means (not shown) to the cell superstructure (also not shown). The alumina rests on a frozen crust 24 of bath which is disposed over the molten salt electrolyte 25. Periodically the frozen crust is broken to allow the alumina to flow into the bath to replenish same.

The bottom surface 17 of the anodes 14 are maintained as close as possible to the sloped cathode surface 18 to reduce the voltage drop between the anode and the cathode and to thereby significantly reduce the energy consumption per unit of metal produced. Care should be exercised to avoid shorting between the anode and cathode surfaces and the unequal current distribution between the anodes.

Figure 3:
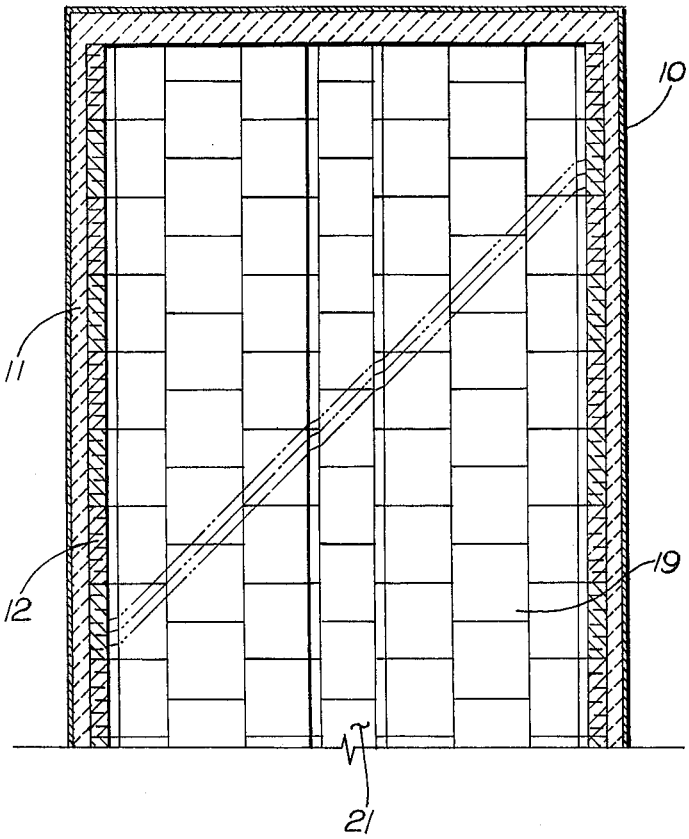
FIG. 3 is a horizontal section taken at 3—3 of FIG. 1.

FIG. 3 is a plan view of the cell illustrating a typical arrangement of $TiB_2$ plates 30. In this drawing the cell superstructure, bath and thin layer of molten metal have not been shown for purposes of clarity.

After the files are installed in accordance with the invention, the cell is slowly heated to operating temperatures of about 975° F to avoid subjecting the plates to thermal shock. The tiles should be protected with a covering of inert gas to minimize oxidation during heat-up. When the cell is at or near operating temperature, molten electrolyte is added to the cell cavity and an electrical current is passed through the cell so that aluminum metal can be produced and the aluminum carbide bond formed. The cell current is gradually increased to the operating level. The aluminum carbide bond is gradually formed so that it is sufficiently strong for normal cell operation. Alumina feeding and anode changing must be done carefully to prevent the deposit of large quantities of alumina on the cathodic surface.

Cell operation generally follows conventional operating practices except for maintaining a much smaller anode-cathode distance. Because there is no large mass of molten aluminum on the cathode surfaces as in a conventional cell, there is relatively no molten metal movement due to electromagnetic forces. However, the molten electrolytic bath is circulated at a sufficient rate by the gas flow along the lower surface of the anodes to avoid build-up of large quantities of undissolved alumina on the cathode surface, which can interfere with cell operations.

The following examples are provided to illustrate the invention.

EXAMPLE I

A small 250 amp reduction cell was prepared with a sloped cathode of graphite having $TiB_2$ plate (2 in. × 2 in. × ¼ in.) bonded to the graphite surface by a graphitic cement (Dylon ® cement manufactured by Dylon Industries). The oxygen content of the plates were less than 0.05%. The plates were bonded in place with a space of ⅛ in. between the mating edges. The cell was slowly heated to 975° C with the plates protected by inert gas and then filled with electrolytic bath (cryolite, $AlF_3$, $CaF_2$) with an alumina content of about 10%. The cell current during operation was 250 amps and cell voltage was 3.9 volt with an anode-cathode distance of about ½ in. During the initial operation of the cell the $TiB_2$ plates could be readily displaced by a steel probe but after about 16 hours of electrolysis the aluminum carbide bond had apparently formed because the tiles could no longer be displaced by the probe. During cell start-up the current efficiency is quite low but it gradually increases over a period of time and generally follows (probably as a result of) the aluminum carbide bond formation. After about 60 hours of electrolysis cell operation was terminated and an autopsy was conducted on the cathode structure. The titanium boride plates were examined and no deleterious effects were noted. The plates were firmly bonded to the graphite cathode substrate by an aluminum carbide bond, the identity of which was confirmed by X-ray analysis. Surprisingly, the aluminum carbide bond was found to be stronger than the $TiB_2$ plate. It was also noted that aluminum metal bridged the gap between the $TiB_2$ plates and apparently protected the aluminum carbide which forms in the gap from attack by the cryolite bath.

EXAMPLE II

A small 70 amp reduction cell was prepared with a sloped cathode of graphite having high purity (less than 0.05% oxygen) $TiB_2$ plate (2-⅞ in. × 4 in. × ¼ in.) bonded thereto as described in Example I except that an aluminum wire screen was disposed at the interface. The cell was slowly heated to 975° C, filled with molten electrolytic bath as described in the previous example and subjected to 72 hours of electrolysis. The current density was about 6 amps/in$^2$ during electrolysis. The aluminum carbide bond readily formed.

It is obvious that various modifications and improvements can be made to the present invention without departing from the spirit of the invention and the scope of the appended claims. For example the bond described can be formed in situ between the RHM and the substrate outside of the environment of the reduction cell and then composite can be installed in a reduction cell.

What is claimed is:

1. In an aluminum reduction cell comprising a shell defining a cavity with the inner surfaces thereof lined with refractory material, at least one electrode depending into the cavity, and a second electrode of opposite polarity to the first mentioned electrode wherein the surface of at least one of the electrodes is protected by refractory hard metal, the improvement comprising an aluminum carbide bond at the interface between the refractory hard metal and the protected electrode surface which is formed in situ at the interface thereof by reacting a carbonaceous material with molten aluminum.

2. The improvement of claim 1 wherein the bond formation is accelerated by passing an electrical current across the said interface.

3. The aluminum reduction cell of claim 1 wherein the protected electrode surface is electrically connected to cathode bars disposed within the refractory lining on the floor of the shell and is inclined from the horizontal so that molten aluminum formed on the inclined cathodic surface during the operation of the cell will drain off except for a thin layer of molten aluminum which wets the refractory hard metal surface.

4. The improvement of claim 1 wherein the refractory hard metal consists essentially of titanium diboride.

5. A cathode structure for an aluminum reduction cell comprising a conductive cathode support and refractory hard metal shape bonded thereto by means of an aluminum carbide bond which is formed in situ at the interface thereof by reacting a carbonaceous material with molten aluminum under the influence of an electrical current.

6. A composite structure comprising a conductive support surface and planar shape of refractory hard metal bonded to the support surface by means of an aluminum carbide bond which is formed in situ at the interface thereof by reacting a finely divided carbonaceous material with molten aluminum.

7. The composite structure of claim 6 wherein the bond formation is accelerated by passing an electrical current across the said interface.

8. A method of bonding a planar shape of refractory hard metal to a support surface comprising reacting a finely divided carbonaceous material with molten aluminum at the interface thereof to form aluminum carbide in situ which bonds the refractory hard metal plate to the support surface.

9. The method of claim 8 wherein the support surface is conductive and an electrical current is passed across the interface to accelerate bond formation.

10. A method of forming an aluminum carbide bond between a protective RHM planar shape and a conductive cathodic surface in an aluminum reduction cell containing molten aluminum and a molten cryolite electrolyte comprising:

A. providing finely divided carbonaceous material at the interface between the cathodic surface and the RHM shape;

B. electrolyzing the reduction cell containing a molten cryolite electrolyte so as to pass an electric current across the said interface and thereby accelerate the reaction between molten aluminum at said interface with the finely divided carbonaceous material to form aluminum carbide which bonds the RHM to the cathodic surface.

11. The method of claim 10 wherein the carbonaceous material is graphitic in nature and is applied to the interface with a low molecular weight organic carrier to form a temporary bond between the RHM plate and cathodic surface.

12. The method of claim 10 wherein aluminum metal is provided at the interface along with the carbonaceous material during installation of the RHM shape on the cathodic surface of the reduction cell.

13. The method of claim 7 wherein the current density across the interface is about 2 to 20 amps/in$^2$.

14. The method of claim 13 wherein the current density is about 4 to 10 amps/in$^2$.

15. The method of claim 10 wherein the RHM plate consists essentially of titanium diboride.

16. The improvement of claim 4 wherein the titanium diboride contains less than 0.05% by weight oxygen.

17. The improvement of claim 4 wherein the titanium diboride contains less than 0.01% by weight oxygen.

18. The method of claim 15 wherein the titanium diboride contains less than 0.05% by weight oxygen.

19. The method of claim 15 wherein the titanium diboride contains less than 0.01% by weight oxygen.

* * * * *

UNITED STATES PATENT AND TRADEMARK OFFICE

CERTIFICATE OF CORRECTION

PATENT NO. : 4,093,524

DATED : June 6, 1978

INVENTOR(S) : John R. Payne

It is certified that error appears in the above-identified patent and that said Letters Patent are hereby corrected as shown below:

Column 4, line 44, "5/8" should be --1/8"--

Column 7, line 16, "support" should be --support surface--

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*